US005131126A

United States Patent [19]

Katsuki et al.

[11] Patent Number: 5,131,126

[45] Date of Patent: Jul. 21, 1992

[54] METHOD FOR DESCALING HOT-ROLLED STAINLESS STEEL STRIP

[75] Inventors: Yasuhiro Katsuki; Kuniaki Sato; Genichi Ishibashi; Hiroyuki Kaito, all of Chiba, Japan

[73] Assignee: Kawasaki Steel Corporation, Hyogo, Japan

[21] Appl. No.: 687,994

[22] Filed: Apr. 19, 1991

[30] Foreign Application Priority Data

Apr. 20, 1990 [JP] Japan ..... 1-104626
Nov. 27, 1990 [JP] Japan ..... 1-324504

[51] Int. Cl.[5] ..... B21C 43/00

[52] U.S. Cl. ..... 29/81.06; 29/81.12; 29/81.01; 134/15

[58] Field of Search ..... 29/81.01, 81.05, 81.11, 29/81.12, 81.13; 134/26-30, 2, 3, 41, 19, 15

[56] References Cited

U.S. PATENT DOCUMENTS 3,617,039 11/1971 Fukui et al. ..... 134/15
3,715,236 2/1973 Fukui et al. ..... 134/15
3,778,309 12/1973 Jackson ..... 134/15
3,873,280 3/1975 Block et al. ..... 134/15
4,619,708 10/1986 Bothner ..... 134/15
4,872,245 10/1989 Kawasaki et al. ..... 29/81.12

*Primary Examiner*—P. W. Echols
*Assistant Examiner*—David P. Bryant
*Attorney, Agent, or Firm*—Bierman and Muserlian

[57] ABSTRACT

A descaling method for removing oxide scale from a hot-rolled stainless steel strip. A solution of an alkaline earth metal chloride is applied to the surface of the oxide scale layer formed on the hot-rolled stainless steel strip, and the solution is allowed to penetrate into the oxide scale layer. In a subsequent annealing, the solution is heated and dehydrated to become solid matter and the dehydrated matter is melted and diffused into the oxide scale layer to soften the oxide scale layer. The oxide scale layer is then removed by a simple mechanical descaling by, for example, grinding brushes with or without a subsequent chemical descaling by a weak acid solution.

4 Claims, 4 Drawing Sheets

METHOD FOR DESCALING HOT-ROLLED STAINLESS STEEL STRIP

BACKGROUND OF THE INVENTION

1. FIELD OF THE INVENTION

The present invention relates to a method for descaling a hot-rolled stainless steel strip and more particularly, to a descaling method which improves the descaling step for removing scale from the surface of a stainless steel strip, while improving the state of the strip surface after the descaling.

2. DESCRIPTION OF THE PRIOR ART

In general, a stainless steel strip is more liable to exhibit work hardening as compared with ordinary steel strips and, hence, tends to increase the load during cold rolling. In order to reduce the load in cold rolling, it has been proposed and carried out to effect a continuous annealing followed by descaling on hot-rolled stainless steel strips by an equipment called an AP line (Annealing and Pickling Line). As to the detail of this treatment, a reference is to be made to, for example, Iron and Steel Handbook III (1), Maruzen, May 15, 1980, particularly "Basics of Rolling of Steel strips", pp 699–700.

FIG. 5 shows the outline of the conventional AP line. This AP line has a pay-off reel 1, an entry-side shear 2, a welder 3 and an entry-side looper 4. Numeral 5 designates an annealing furnace having a heating section 6 and a cooling section 7. The heating section 6 includes a preheating zone, heating zone and a soaking zone. The AP line further has a shot blast 8, a plurality of pickling tanks 9, 10, 11 including a sulfuric acid tank, nitro-fluoric acid tank and a nitric acid tank, a rinsing device 12, a drier 13, a delivery-side looper 14, a shear 15 and a tension reel 16.

According to a current practice, a scale breaker including a roll bender is disposed on the entry-side of the shot blast 8, in order to enhance the descaling effect. It is also attempted to provide a grinding brush on the delivery-side of the shot blast 8.

In the operation of this AP line, a hot-rolled stainless steel strip S uncoiled from a pay-off reel 1 is made to pass through the entry-side shear 2 which cuts and trims the leading end or trailing end of the stainless steel sheet S. The trimmed end of the stainless steel sheet S is jointed to a preceding coil or a subsequent coil by means of a welder 3. The stainless steel sheet S is then fed through the entry-side looper 4 into the annealing furnace 5 so as to be heat-treated in this furnace. More specifically, in the heating section 6 of the annealing furnace 5, the stainless steel strip S is supported in the form of a catenary by means of asbestos rolls 71 and is heat-treated by a direct contact of a flame formed by a burner. The sheet S is then moved into the cooling section 7 where it is cooled by air or water. The steel strip S is then mechanically descaled by, for example, a shot blast and is then made to pass through the pickling tanks including a nitro-fluoric acid tank so as to be chemically descaled and passivated. The steel sheet S is then made to pass through the rinsing device 12 in which the surfaces of the steel sheet S are cleaned by brushing and spraying, and is further introduced into the drier to be dried. The steel strip is then advanced through the delivery-side looper 14 to the shear 15 so as to be cut at a predetermined length. The steel sheet S is then coiled into the tension reel 16.

In this conventional AP line, annealing is effected by direct contact of the burner flame, so that the oxide scale of about 5 μm thick, which has been formed on the surface of the steel strip S during hot rolling, grows to have finer structure and a greater thickness of 10 to 30 μm. The oxide scale thus grown up on the stainless steel is extremely difficult to remove as compared with the case of ordinary steel strips, because the structure of the scale is very fine. This is the reason why both mechanical descaling by a shot blast and chemical descaling such as pickling by a plurality of acid tanks are necessary. The shot blast is indispensable, particularly when the stainless steel strip has been hot rolled. In addition, the pickling has to be done for a considerably long time with a pickling solution having a very high concentration, e.g., 20 wt% or so, of a strong acid such as sulfuric acid, nitro-fluoric acid (mixture of nitric acid and fluoric acid) or nitric acid. Consequently, a very long time is required for descaling, making it difficult to enhance the yield of the product.

It is also to be pointed out that the surfaces of the steel strip are undesirably roughened as a result of collision by shot grains during the shot blasting. In addition, pickling by a strong acid such as nitric acid undesirably enhances corrosion at grain boundaries. Namely, annealing of a stainless steel strip causes a chromium depleted zone in grain boundaries so as to allow a heavy corrosion of the grain boundaries by the pickling. Nevertheless, the use of nitro-fluoric acid as the pickling liquid for austenitic stainless steel strip is indispensable because this acid has quite a strong descaling effect, as a cost of the grain boundary corrosion.

Presence of minute convexities and concavities, i.e., roughness, formed as a result of shot blasting or grain boundary corrosion in the stainless steel strip surface allows generation of partial luster defect in the subsequent cold rolling. Generation of this defect is considered to be attributable to "scab" of minute projections on the sheet surface during the cold rolling.

Hitherto, various proposals have been made for reducing the requirement for descaling thereby to overcome the above-described problems. For instance, Japanese Pat. Laid-Open No. 49-135824 discloses a method in which an agent mainly composed of an alkaline metal salt and/or boric acid is applied to a hot-rolled ordinary steel strip so as to fuse the oxide film with said salt, whereby a steel strip easy to descale is obtained. According to this method, it is possible to reduce fluctuations in pickling time attributable to variations in the state of oxide scale, thus shortening the pickling time. On the other hand, Japanese Pat. Laid-Open No. 61-153291 discloses a method in which an aqueous solution of an alkaline metal halide is applied to the surface of a hot-rolled stainless steel sheet, followed by annealing, cooling and pickling, whereby the stainless steel strip is descaled at a high efficiency.

The method disclosed in Japanese Pat. Laid-Open No. 49-135824, however, is intended for use on ordinary steel strips which do not essentially require annealing and descaling prior to pickling. In addition, this method is not effective in removing spinel-type oxide film which is peculiar to stainless steel strips.

The method disclosed in Japanese Pat. Laid-Open No. 61-153291 exhibits an appreciable effect in removing persistent oxide scale formed on stainless steel strip. This effect, however, is not so large as to enable omission of shot blasting. In addition, this method utilizes a strong acid solution, in particular nitro-fluoric acid, as the pickling liquid, failing to meet the demand for improving the state of surface of the steel strip. Thus, the aforementioned problems of the prior art still remain unsolved.

SUMMARY OF THE INVENTION

Accordingly, an object of the present invention is to provide a descaling method for stainless steel strips which is fundamentally improved by omitting pickling with nitro-fluoric acid and shot-blasting, thus offering various advantages such as simplification of descaling process, reduction in the cost, improvement in the production efficiency, improvement in the state of the strip surface after descaling, and improvement in the working environment, thereby overcoming the above-described problems of the prior art.

To this end, according to the present invention, there is provided a descaling method for a hot-rolled stainless steel strip, comprising the steps of:

applying a solution of an alkaline earth metal chloride to the surface of an oxide scale layer formed on the hot-rolled stainless steel strip, and allowing the solution to penetrate into the oxide scale layer;

annealing the stainless steel strip so as to have the solution dehydrated to obtain solid dehydrated matter which then melts and diffuses into the oxide scale; and subjecting the stainless steel strip to a descaling operation.

According to the invention, the descaling operation may be a mechanical descaling operation which employs at least one of descaling with a grinding brush, descaling with a grinding belt, descaling with bending rolls and descaling with pinch rolls.

The descaling treatment also may employ, in combination with the above-mentioned mechanical descaling treatment, a chemical descaling treatment which utilizes nitric acid and/or sulfuric acid.

According to the descaling method for stainless steel strips of the present invention, descaling of a hot-rolled stainless steel strip is conducted by applying a solution of an alkaline earth metal chloride on the surface of the stainless steel strip in advance of an annealing, so as to cause the solution to penetrate into the layer of oxide scale on the stainless steel to reach the base metallic region by capillary action, so as to reduce the mechanical strength of the oxide scale.

In a subsequent annealing in an annealing furnace, the water content of the alkaline earth metal chloride in the oxide scale layer evaporates at 100° C. so that the solid matter is obtained. This solid matter is molten at 700°to 800° C. so as to be finely diffused into the oxide scale layer. Then, during a further rise of the temperature in the annealing, the molten matter reacts with the oxide scale in a manner of a solid-liquid reaction. Very persistent oxide scales having spinel structure such as $Cr_2O_3$, $Fe_3O_4$ and $FeCr_2O_4$, generated on the surface of the stainless steel strip in the course of hot rolling, are changed into chlorides of Cr and which contain alkaline earth metal and which has indefinite form and very small mechanical strength. These chlorides are very soft and, hence, can easily be peeled off the surface of the stainless steel strip.

Furthermore, as the alkaline earth metal chloride solution is made to penetrate to reach the base metallic region through the oxide scale layer in advance of the annealing, the aforementioned solid matter in the molten state are finely diffused through the oxide layer on the stainless steel strip during the annealing. The diffused matter prevents oxygen contained in the burnt gas used in the annealing from reaching the base metallic region, so that the base metallic region never reacts with the oxygen. As a consequence, growth of oxide scale on the surface of the steel strip is substantially avoided.

For the reasons described above, the descaling method of the present invention reduces or eliminates the necessity for pickling and allows one to omit shot blasting. Namely, according to the present invention, the oxide scale on the stainless steel strip is re-constituted into an oxide scale which has a low mechanical strength during annealing and, at the same time, growth of the oxide scale during annealing is suppressed, so that the shot-blasting for breaking and removing the oxide scale can be eliminated. Most of the re-constituted oxide scale can be removed simply by a brushing conducted with, for example, a grinding brush. Any oxide scale remaining after the brushing can be removed easily by cleaning with sulfuric acid and/or nitric acid, without using nitro-fluoric acid. As a consequence, the descaling step is simplified and the production efficiency can be improved. Furthermore, roughening of the surface of the steel strip caused by shot-blast grains and cleaning with nitro-fluoric acid can be avoided so that the state of the stainless steel strip after descaling is greatly improved. Furthermore, running cost is remarkably reduced to lower the production cost, through elimination of shot-blasting and simplification of the pickling.

Solution applied to the surface of the stainless steel strip should be of alkaline earth metal chloride type. In general, an alkaline earth metal chloride has a high boiling temperature so that it is not evaporated at the temperature for annealing the stainless steel strip. Therefore, this solution does not produce any undesirable effect on equipment such as refractories, asbestos roll and flue provided in the annealing furnace.

The above and other objects, features and advantages of the present invention will become clear from the following description of the preferred embodiments when the same is read in conjunction with the accompanying drawings.

DESCRIPTION OF THE PREFERRED EMBODIMENT

A description will now be given of an apparatus which is suitable for use in carrying out the descaling method of the present invention.

Figure 1:
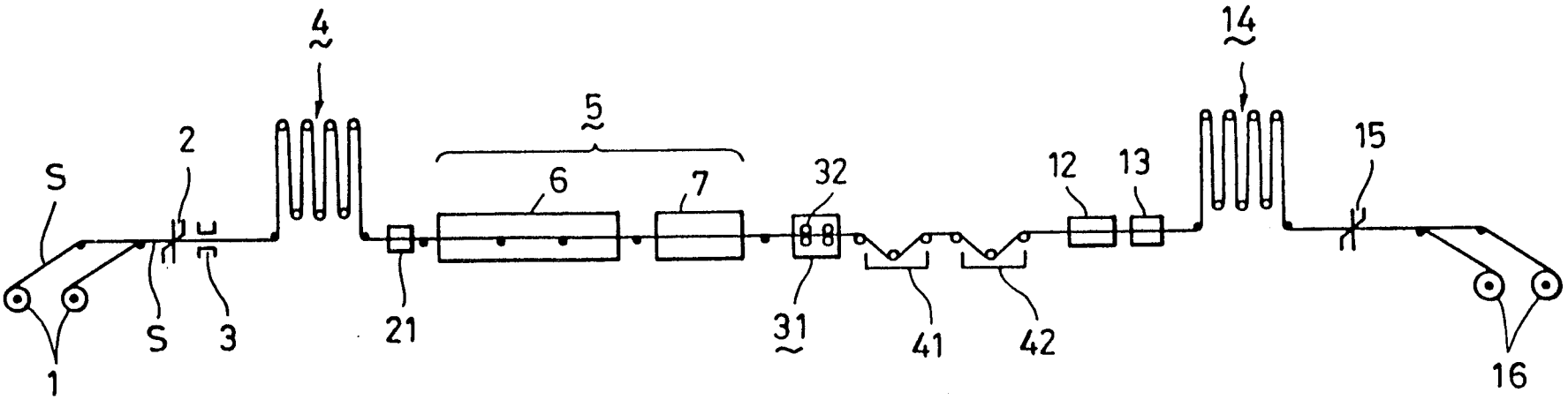
FIG. 1 is a schematic illustration of the construction of an AP line which embodies the descaling method of the present invention.
Figure 2:
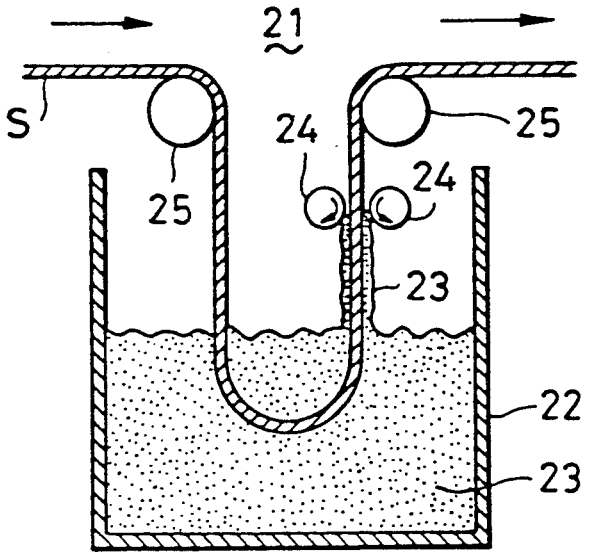
FIG. 2 is an enlarged sectional view of an apparatus for applying a solution of an alkaline earth metal chloride.

FIG. 1 shows an example of AP line which is suitable for use in carrying out the method of the present invention for descaling the stainless steel of the present invention. In this Figure, the same reference numerals are used to denote the same parts or components as those used in the conventional apparatus described before in connection with FIG. 5. The stainless steel strip S unwound from the pay-off reel is cut at its leading or trailing end by a entry-side shear 2 and is welded by a welder 3 to a leading or trailing coil. The stainless steel strip S is then fed into an apparatus 21 for applying an alkaline earth metal chloride solution, through an entry-side looper 4. This apparatus 21 has, as shown in FIG. 2, a solution tank 22 containing an aqueous solution 23 of an alkaline earth metal chloride, through which the stainless steel sheet S is passed so that the aqueous solution 23 of the alkaline earth metal chloride is uniformly applied to the surfaces of the steel strip S. Subsequently, the stainless steel strip S is pressurized by processing rolls 24, whereby the aqueous solution 23 of the alkaline earth metal chloride is made to penetrate into the oxide scale 50 on the stainless steel strip S so as to reach the base metallic region of the strip, as shown in FIG. 3.

Figure 3:
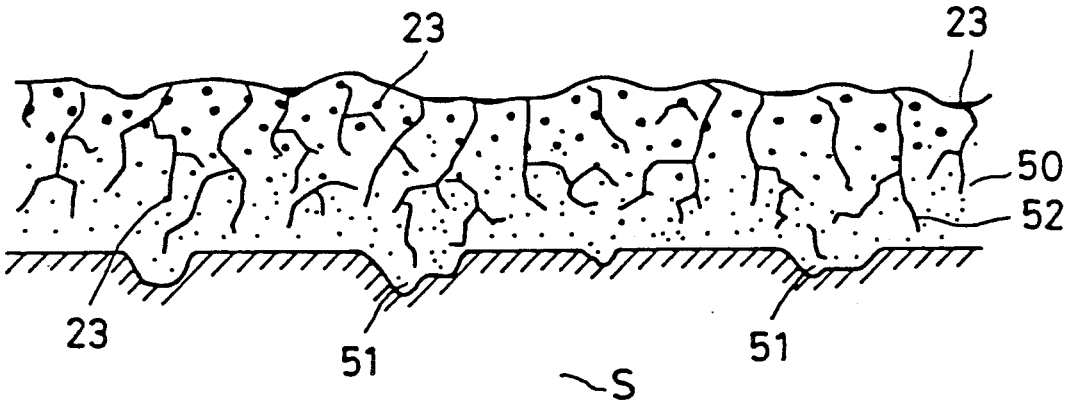
FIG. 3 is a schematic sectional view of the surface region of a stainless steel strip illustrative of penetration of an alkaline earth metal chloride solution into oxide scale formed on the stainless steel strip which is an effect peculiar to the present invention.

It will be seen from FIG. 3 that the aqueous solution 23 of the alkaline earth metal chloride has penetrated into the layer of oxide scale 50 on the surface of the stainless steel strip S through fine cracks 52 existing in the oxide scale 50 by capillary action, so as to reach the fine recesses 51 formed in the base metallic region of the stainless steel strip.

The stainless steel strip S is then fed into the heating zone 6 of an annealing furnace 5, through a roll 25, so as to be heat-treated at a predetermined temperature. As a result of the heating, water content of the aqueous solution 23 of the alkaline earth metal chloride penetrating into the oxide scale 50 is evaporated so that the solution is changed into solid matter and, as a result of a temperature rise, the solid matter is molten so as to be finely diffused into the layer of oxide scale 50, causing a solid liquid reaction between the alkaline earth metal chloride solution 23 and the oxide scale 50. The stainless steel strip S is then advanced into a cooling zone 7 of the annealing furnace 5, to be cooled to a predetermined temperature.

Figure 4:
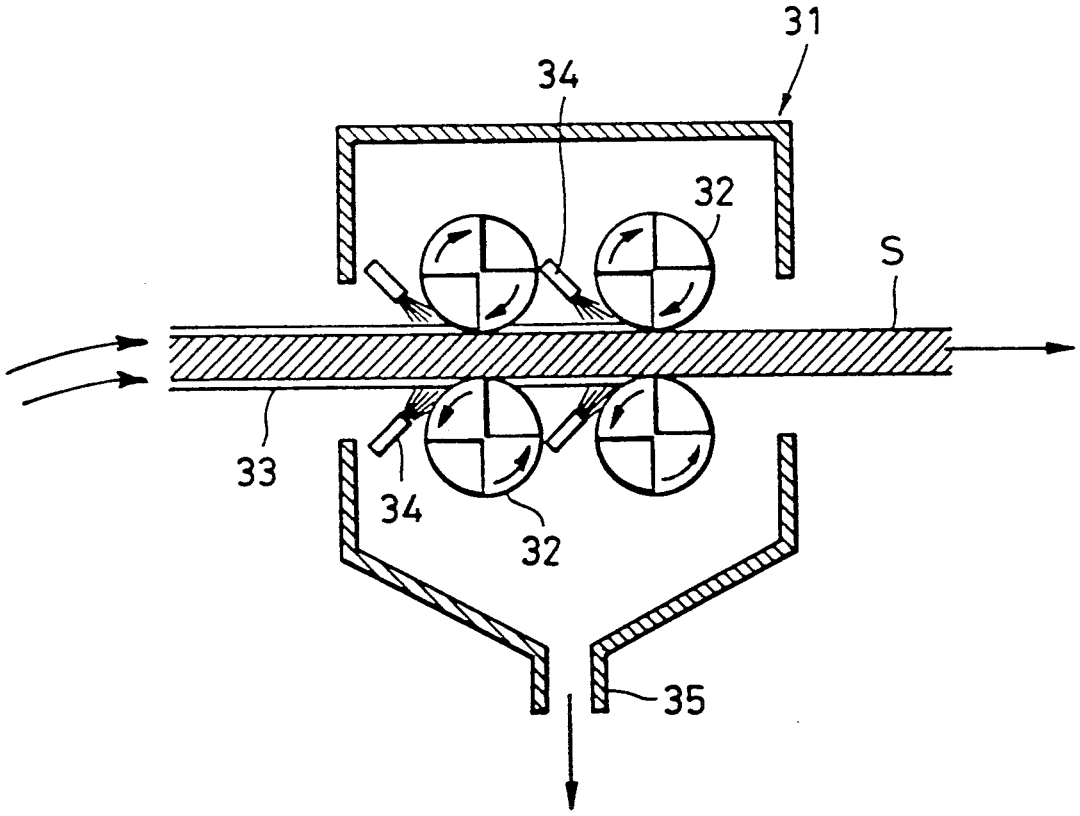
FIG. 4 is an enlarged sectional view of an apparatus incorporated in the AP line shown in FIG. 1 for removing oxide scale.

The stainless steel strip S is then supplied to a descaling apparatus 31 for removing the oxide scale. In order to remove the product 33 of reaction between the alkaline earth metal chloride and the oxide scale on the surface of the stainless steel strip S, this descaling apparatus 31 has two pairs of grinding brushes 32 arranged in series, each pair including an upper brush and a lower brush opposing each other, as will be seen from FIG. 4. These grinding brushes 32 are adapted to rotate in the direction counter to the direction of feed of the stainless steel strip S to produce a grinding effect thereby removing the above-mentioned reaction product 33 from the surfaces of the stainless steel strip S. The reaction product 33 thus freed from the surface of the stainless steel strip S is washed away by a spray 34 of water and is discharged from a discharge pipe 35 provided on the lower end of the descaling apparatus 31. It is thus possible to easily remove the reaction product 33 from the surface of the stainless steel strip by the grinding effect produced by the grinding brushes 32, thus eliminating necessity for a shot blasting.

In the event that a certain portion of the reaction product 33 remains on the stainless steel strip S even after the brushing effected by the grinding brushes 32, the stainless steel strip S is fed to a pickling tank 41 containing an acid other than nitro-fluoric acid, e.g., sulfuric acid, hydrochloric acid or the like which does not cause any grain-boundary corrosion unlike the conventionally used nitro-fluoric acid. The stainless steel strip S is then fed to a nitric acid tank 42 in which a final pickling is conducted to passivate the stainless steel sheet S.

Subsequently the stainless steel strip S is made to pass through a rinsing device 12 and a drier 13 and then to a shear 15 through an delivery-side looper 14, so as to be cut in a predetermined length, and the cut stainless steel sheet S is coiled into a tension reel 16.

If no substantial residue of the reaction product exists on the surface of the stainless steel strip S after the descaling by brushing, the stainless steel strip S may be pickled only through the nitric acid tank 42, without being pickled through the pickling tank 41. If there is no residual reaction product and no passivation is required, the descaled stainless steel strip S may be fed directly to the rinsing apparatus 12 by-passing the pickling tank 41 and the nitric acid tank 42.

Example 1

Figure 5:
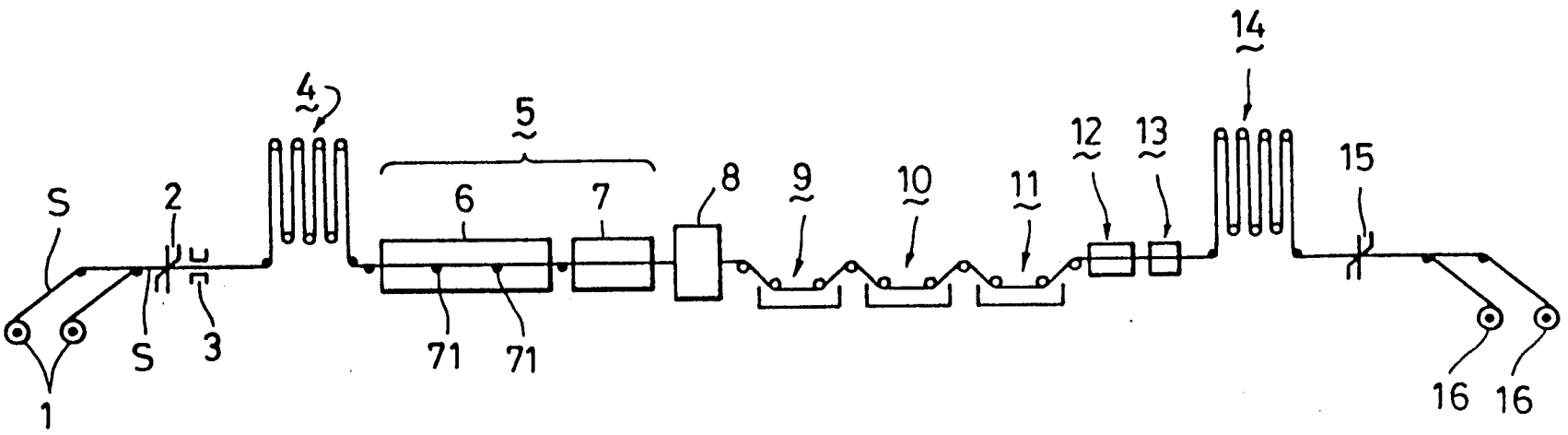
FIG. 5 PRIOR ART
FIG. 5 is a schematic illustration of an AP line which is used for carrying out conventional descaling method for steel strips.

Hot-rolled stainless steel strips were descaled respectively through the AP line of FIG. 1 carrying cut the present invention and the conventional AP line shown in FIG. 5. In each case, the descaling was conducted under the conditions shown in Table 1. The changes in the states of deposition of oxide scales on these stainless steel strips S were examined and compared.

TABLE 1

| | Conditions |
|---|---|
| Strip material | Stainless steel strip SUS 304 |
| Composition of alkaline earth metal chloride solution | $CaCl_2$ 15 wt %, water 85 wt % |
| Temperature in heating zone (°C.) | 1150 |
| Temperature of cooling zone (°C.) | 100 |
| Surface treating acid | 15 wt % nitric acid |
| Strip moving velocity | 40 m/min |

Table 2 shows the thicknesses of the oxide scale as measured before and after the stainless steel strips S were annealed through the annealing furnaces.

TABLE 2

| | Before annealing | After annealing |
|---|---|---|
| Steel strip A | 5.0 μm | 5.0 μm |
| Steel strip B | 5.0 μm | 20.0 μm |

The stainless steel strip A has been treated by the method of the present invention: namely, the aqueous solution of alkaline earth metal chloride was applied to the hot-rolled stainless steel sheet S before the strip S was introduced into the annealing furnace 5 and was descaled after the annealing without being subjected to a shot-blasting and pickling with nitro-fluoric acid, while the stainless steel strip B was treated by a conventional method, i.e., descaled by a shot-blasting and a pickling with a nitro-fluoric acid after the annealing, without application of the aqueous solution of alkaline earth metal chloride.

As will be seen from Table 2, the stainless steel strip A treated by the method of the present invention did not show any change in the scale thickness after the annealing, whereas the stainless steel strip B treated by the conventional method showed an increase in the scale thickness to a value which is 4 times as large as the thickness before the annealing. This clearly shows that, in the method of the invention, the application of $CaCl_2$ to the surface of the stainless steel strip before introduction of the strip into the annealing furnace 5 effectively prevents oxygen in the burning gas in the annealing furnace 5 from penetrating into the oxide scale on the stainless steel strip so as to inhibit growth of the oxide scale.

Table 3 shows the manners of descaling after the stainless steel strips were delivered from the cooling zones 7 of the annealing furnaces 5 of the respective AP lines. The numerical values of percentage (%) represent the ratio of remaining oxide scale in terms of area ratio. Thus, 0 % means complete removal of the oxide scale.

TABLE 3

| | Stainless steel strip A | Stainless steel strip B |
|---|---|---|
| Application of solution of alkaline earth metal chloride | Applied | Not applied |
| Cooling zone outlet | 100% | 100% |
| Shot-blast outlet | By-passed | 80% |
| Brush outlet | 5% | 75% |
| After 30 sec immersion in 20 wt % $H_2SO_4$ | By-passed | 50% |
| After 30 sec immersion in 3-15 wt % $HF.HNO_3$ | By-passed | 8% |
| After 20 sec immersion in 15 wt % $HNO_3$ | 0% | 0% |

As will be seen from Table 3, about 95 % of the reaction product 33 has been removed from the stainless steel strip A when the strip A has passed through the grinding brush 32 (only one brush stand was used) disposed on the delivery-side of the cooling zone. This is attributable to the fact that the oxide scale having strong spinel structure has been changed, through the annealing, into chlorides of Cr and Fe containing the alkaline earth metal and having mechanical strengths low enough to enable an easy removal by brushing. Thus, in the case of the stainless steel strip A, descaling was completed without difficulty even through a short treatment with a weak nitric acid (20 seconds, 15 wt%), and the stainless steel strip A thus treated showed a good state of the surface with high degrees of metallic luster and whiteness without roughness.

In contrast, in the case of the stainless steel strip B, the oxide scale of strong spinel structure remained after the annealing, so that the descaling could not be completed without the hard mechanical descaling by brushing and cleaning with a strong acid such as nitro-fluoric acid.

EXAMPLE 2

A test was conducted through the AP line shown in FIG. 1, using two brush stands 32. Stainless steel strips were treated with this AP line while the density of the aqueous solution of alkaline earth metal chloride ($CaCl_2$) was varied. The remaining ratio (%) of the oxide scales on these stainless steel strips after passing through the grinding brushes 32 were examined to obtain results as shown in Table 4.

In Table 4, the mark ⊙ represents that good surface state with no residual oxide scale was observed, ○ represents that the surface state was almost as good because only slight residual oxide scale was observed, Δ represents that not so small amount of oxide film remained, and × represents that considerable amount of oxide scale remained locally.

As will be understood from Table 4, the mechanical strength of the oxide scale generated during hot-rolling was appreciably reduced to allow an easy descaling by the grinding brushes 32, when the concentration of $CaCl_2$ in the solution was 10 wt% or greater When the concentration of $CaCl_2$ was increased to 15 wt%, no residue of oxide scale was observed after the descaling with the grinding brushes and good appearance of the strip surface with high degrees of metallic luster and whiteness could be obtained even after nitric acid of low density (15 wt%) was used as the final surface treating acid. For information, the

TABLE 4

| $CaCl_2$ density (wt %) | Number of brush passes | Oxide scale remaining ratio after brushing (%) | State of surface | Evaluation |
|---|---|---|---|---|
| 1.0 | 2 | 10.0 | Oxide scale remained locally | × |
| 2.0 | 2 | 7.0 | Oxide scale remained locally | × |
| 5.0 | 2 | 3.0 | Not so small amount of oxide scale remained | Δ |
| 10.0 | 2 | 0.5 | Oxide scale remained slightly | |
| 15.0 | 2 | 0 | Metallic luster exhibited | ⊙ |
| 20.0 | 2 | 0 | Metallic luster exhibited | ⊙ |
| 30.0 | 2 | 0 | Metallic luster exhibited | ⊙ |

saturation concentration of the $CaCl_2$ in the aqueous solution was 40 wt%.

According to the present invention, it is thus possible to reconstitute the oxide scale so as to reduce the mechanical strength of the same, by using an aqueous solution of $CaCl_2$ having a concentration of 10 wt% or greater, preferably 15 wt% or greater.

EXAMPLE 3

Stainless steel strips were subjected to application of an aqueous solution of an alkaline earth metal chloride, annealing and mechanical descaling conducted with grinding brushes. The composition of the aqueous solution, conditions of annealing and conditions of mechanical descaling are shown in Table 5. The descaled stainless steel strips were then finally pickled by various acids shown in Table 5. The qualities of the surfaces of the thus treated stainless steel strips, i.e., depth of grain boundary corrosion and surface roughness, were examined to obtain the results as shown in Table 6.

The grain boundary corrosion depths and surface roughness RZ as measured after the grinding brushing, i.e., before the final pickling, were 0 to 1 μm and 3 to 4 μm, respectively. Stainless steel strips also were treated by the conventional AP line shown in FIG. 5, In this case, the grain boundary corrosion depths and surface roughness were respectively 6 to 7 μm and 15 to 20 μm.

TABLE 5

| | Conditions |
|---|---|
| Strip material | Stainless steel strip SUS 304 |
| Composition of alkaline earth metal chloride solution | $CaCl_2$ 15 wt %, water 85 wt % |

TABLE 5-continued

| Conditions | |
|---|---|
| Strip material | Stainless steel strip SUS 304 |
| Temperature in heating zone (°C.) | 1150 |
| Temperature of cooling zone (°C.) | 100 |
| Shot-blasting | Not conducted |
| Number of grinding brush pass | 1 pass |
| Acids used in final pickling | $HNO_3$ 15 wt %<br>$H_2SO_4$ 15 wt %<br>HCl 15 wt %<br>HFG.$HNO_3$ 2.5-12.5 wt % |

TABLE 6

| Type of acid | Immersion time | Depth of grain boundary corrosion | Surface roughness |
|---|---|---|---|
| $HNO_3$ | 30 sec | 0 to 1 μm | 3 to 4 μm |
| $HNO_3$ | 60 sec | 0 to 1 μm | 3 to 4 μm |
| $H_2SO_4$ | 30 sec | 0 to 1 μm | 3 to 4 μm |
| $H_2SO_4$ | 60 sec | 0 to 1 μm | 3 to 4 μm |
| HF.$HNO_3$ | 30 sec | 4 to 5 μm | 5 to 6 μm |
| HF.$HNO_3$ | 60 sec | 6 to 7 μm | 6 to 7 μm |
| HCl | 30 sec | 1 to 2 μm | 4 to 5 μm |
| HCl | 60 sec | 2 to 3 μm | 5 to 6 μm |
| $H_2SO_4$ + $HNO_3$ | 30 sec | 0 to 1 μm | 3 to 4 μm |
| $H_2SO_4$ + $HNO_3$ | 60 sec | 0 to 1 μm | 3 to 4 μm |

From Table 6, it is understood that the depth of grain boundary corrosion remains as small as 0 to 1 μm, even when the immersion time is increased from 30 sec to 60 sec, provided that the acid used in the final pickling is one of nitric acid and sulfuric acid or a mixture of these acids. Thus, the grain boundary corrosion does not substantially grow even when the stainless steel strip is immersed in the acid solution for a long time. The surface roughness also remains as small as 3 to 4 μm despite prolongation of the immersion time, provided that the above-mentioned acid is used. In contrast, when nitrofluoric acid (HF·$HNO_3$) was used as the final pickling acid, the grain boundary corrosion depth increased from about 4 to 5 μm to about 6 to 7 μm, when the immersion time was prolonged from 30 seconds to 60 seconds. When this acid (HF·$HNO_3$) was used, the surface roughness also was increased from the value measured before the pickling (3 to 4 μm) to 6 to 7 μm. From this test result, it is understood that the pickling in the descaling method of the present invention can conveniently be carried out with nitric acid or a sulfuric acid alone or with a mixture of these acids.

Although the stainless steel SUS 304 is used as the material of the stainless steel strips in Examples described hereinbefore, it is to be understood that the advantages of the invention could be obtained even with other types of stainless steel.

The aqueous solution of $CaCl_2$ used as the solution of alkaline earth metal chloride also is illustrative and other solutions of various other alkaline earth metal chlorides can be used equally well. For instance, it is possible to use solutions of $MgCl_2$ and $BaCl_2$ in place of the solution of $CaCl_2$ used in the specific Examples.

As will be understood from the foregoing description, according to the method of the present invention for descaling a hot-rolled stainless steel strip, a solution of an alkaline earth metal chloride is applied to the surface of the hot-rolled stainless steel strip before the strip is annealed, so that the solution is caused to penetrate into the oxide scale layer formed on the stainless steel strip so as to reduce the mechanical strength of the oxide scale while preventing growth of the oxide scale during annealing. As a consequence, the descaling method of the present invention enables an easy removal of oxide scale with a simple descaling operation, without requiring shot-blasting and pickling with nitrofluoric acid which have been necessitated in the conventional descaling method.

Thus, the present invention offers various advantages such as simplification of descaling process, increase in the descaling speed and production efficiency and remarkable improvement in the state of the surface of the stainless steel strip after the descaling through reduction in the grain boundary corrosion and surface roughness, thus ensuring improvement in the quality of the product and improvement in the working environment.

Furthermore, when the shot-blast descaling is substituted by a mechanical descaling by at least one of grinding brushes, grinding belt, bending rolls and pinch rolls, it is possible to remarkably suppress the roughening of the surface of the steel strip, thus contributing to an improvement in the quality of the descaled product steel strip.

Improvement in the surface roughness of the descaled stainless steel strip and suppression of the growth of the grain boundary corrosion can be attained by a combination of one of the above-mentioned mechanical descaling operation in place of shot-blasting and a chemical descaling conducted with nitric acid and/or sulfuric acid in place of the conventionally used nitrofluoric acid.

What is claimed is:

1. A method for removing oxide scale from a hot-rolled stainless steel strip comprising the steps of:
   - applying a solution of an alkaline earth mental chloride to the surface of an oxide scale layer formed on a hot-rolled stainless steel strip;
   - allowing said solution to penetrate into said oxide scale layer;
   - annealing said stainless steel strip so that said solution becomes dehydrated and changes into solid matter, and, thereafter, said solid matter melts and diffuses into said oxide scale layer, thereby softening said oxide scale layer; and
   - subjecting said stainless steel strip to a descaling operation.

2. The method according to claim 1, wherein the concentration of the alkaline earth metal chloride in said solution is not lower than 10 wt% and not greater than 40 wt%.

3. The method according to claim 1, wherein said descalingoperation is conducted by a mechanical descaling using at least one of mechanical descaling means selected from the group consisting of a pair of grinding brushes, a grinding belt, a pair of bending rolls and a pair of pinch rolls.

4. The method according to claim 1, wherein said descaling operation is conducted by a combination of a mechanical descaling and a chemical descaling conducted with nitric acid and/or sulfuric acid.

* * * * *